US007594398B2

(12) United States Patent
Gronberg

(10) Patent No.: US 7,594,398 B2
(45) Date of Patent: Sep. 29, 2009

(54) EXHAUST GAS RECIRCULATION FOR AN INTERNAL COMBUSTION ENGINE AND METHOD THEREFOR

(75) Inventor: Philip F. Gronberg, Sugar Grove, IL (US)

(73) Assignee: International Engine Intellectual Property Company LLC, Warrenville, IL (US)

( * ) Notice: Subject to any disclaimer, the term of this patent is extended or adjusted under 35 U.S.C. 154(b) by 0 days.

(21) Appl. No.: 11/689,324

(22) Filed: Mar. 21, 2007

(65) Prior Publication Data

US 2008/0229744 A1 Sep. 25, 2008

(51) Int. Cl.
*F02B 33/44* (2006.01)

(52) U.S. Cl. ..... 60/605.2

(58) Field of Classification Search ..... 60/605.2
See application file for complete search history.

(56) References Cited

U.S. PATENT DOCUMENTS 6,244,256 B1 * 6/2001 Wall et al. ..... 123/568.12
6,935,319 B2 * 8/2005 Aupperle et al. ..... 123/568.12
6,978,772 B1 * 12/2005 Dorn et al. ..... 123/568.12

* cited by examiner

*Primary Examiner*—Thomas Denion
*Assistant Examiner*—Douglas J. Duff
(74) *Attorney, Agent, or Firm*—Jack D. Nimz; Jeffrey P. Calfa

(57) ABSTRACT

An internal combustion engine (100) includes a crankcase (128) having a plurality of cylinders (126). An exhaust system (130) is in fluid communication with the plurality of cylinders (126) and includes a turbine (104) in operable association with a compressor (106). An intake system (124) is in fluid communication with the plurality of cylinders (126) and the compressor (106). A first EGR cooler (136) is in fluid communication with the exhaust system (130) through an inlet passage (142) that is connected to the exhaust system (130) between the plurality of cylinders (126) and the turbine (104). A second EGR cooler (140) is in fluid communication with the intake system (124) through an outlet passage (148) that is connected between the plurality of cylinders (126) and the compressor (106). A transfer passage (144) is disposed between the first EGR cooler (136) and the second EGR cooler (140). The transfer passage (144) contains an EGR valve (138) that is arranged and constructed to control a flow of fluid through the transfer passage (144) while the internal combustion engine (100) operates.

6 Claims, 2 Drawing Sheets

EXHAUST GAS RECIRCULATION FOR AN INTERNAL COMBUSTION ENGINE AND METHOD THEREFOR

FIELD OF THE INVENTION

This invention relates to internal combustion engines, including but not limited to exhaust gas recirculation (EGR) systems.

BACKGROUND OF THE INVENTION

Exhaust gas recirculation (EGR) methods and devices for use with internal combustion engines are known. Most EGR systems include at least one EGR valve and optionally at least one EGR cooler connected in series between an exhaust system and an intake system of an engine. A typical EGR system is capable of mixing a portion of exhaust gas generated by the engine with fresh air entering the engine. Introduction of exhaust gas into an intake air stream of the engine displaces oxygen in the intake stream to yield a lower flame temperature of combustion, and thus, lower nitrous oxide (NOx) emissions.

Some engines, especially compression ignition or diesel engines, use coolers that cool the portion of exhaust gas being recirculated. The cooled exhaust gas has a lower latent heat content and can aid in lowering combustion temperatures even further. In general, engines using EGR to lower their NOx emissions can attain lower emissions by cooling the recirculated exhaust gas as much as possible.

Exhaust gas constituents in the exhaust gas being recirculated on an engine with EGR often present problems when the exhaust gas is cooled below a condensation temperature of those constituents. Various hydrocarbons will typically condense onto engine components and present issues such as sluggish performance or even sticking of moving parts. These issues are especially evident when an engine starts under cold ambient conditions, when most engine components are cold and exhaust gas constituents condensate more readily onto the engine components.

Most engines in the past have attempted to cope with the problem of condensation of exhaust gas constituents by delaying initiation of EGR under cold start conditions, or limiting the amount of exhaust gas being recirculated, or limiting the amount of cooling applied to the recirculated exhaust gas in an effort to minimize the degree and amount of condensates. Such measures, although effective in increasing the service life of engine components and decreasing the likelihood of failures, are insufficient in addressing the impact they have on the emissions generated by the engine. The more delayed the initiation of EGR becomes, or, the limited amount of cooling of the exhaust gas, directionally qualitatively increase the emissions generated by the engine.

Some engine designs cope with the issue of condensation by placing the EGR valve upstream, or on the "hot side", of the EGR cooler. This placement of the EGR valve ensures that the valve will not be exposed to cooled exhaust gas, and thus be immune to the condensation effects that result from the cooling, but these configurations have disadvantages. One disadvantage is the increased flow orifice size required for the EGR valve because the gas passing therethrough is at a high temperature and low density. Increased mass flow rates of exhaust gas through the EGR valve in these systems inevitably leads to large EGR valves. Also, placement of the EGR valve on the hot side of the EGR cooler exposes the EGR valve to high temperatures. With most EGR valves having electronic components and precise mechanical components associated therewith, therefore, the increased service temperature of valves requires use of active cooling systems for them, and also use of exotic materials for the mechanical parts, both of which increase the cost and complexity of these valves and of the engines that use them.

SUMMARY OF THE INVENTION

An internal combustion engine includes a crankcase having a plurality of cylinders. An exhaust system is in fluid communication with the plurality of cylinders and includes a turbine in operable association with a compressor. An intake system is in fluid communication with the plurality of cylinders and the compressor. A first EGR cooler is in fluid communication with the exhaust system through an inlet passage that is connected to the exhaust system between the plurality of cylinders and the turbine. A second EGR cooler is in fluid communication with the intake system through an outlet passage that is connected between the plurality of cylinders and the compressor. A transfer passage is disposed between the first EGR cooler and the second EGR cooler. The transfer passage contains an EGR valve that is arranged and constructed to control a flow of fluid through the transfer passage while the internal combustion engine operates.

DESCRIPTION OF A PREFERRED EMBODIMENT

The following describes an apparatus for an internal combustion engine having an EGR system associated therewith that is capable of operating over a broader than before engine operating range, that is advantageously not prone to failure or loss of performance due to exhaust gas constituent deposits on the EGR valve due to overcooling of the recirculated exhaust gas.

Figure 1:
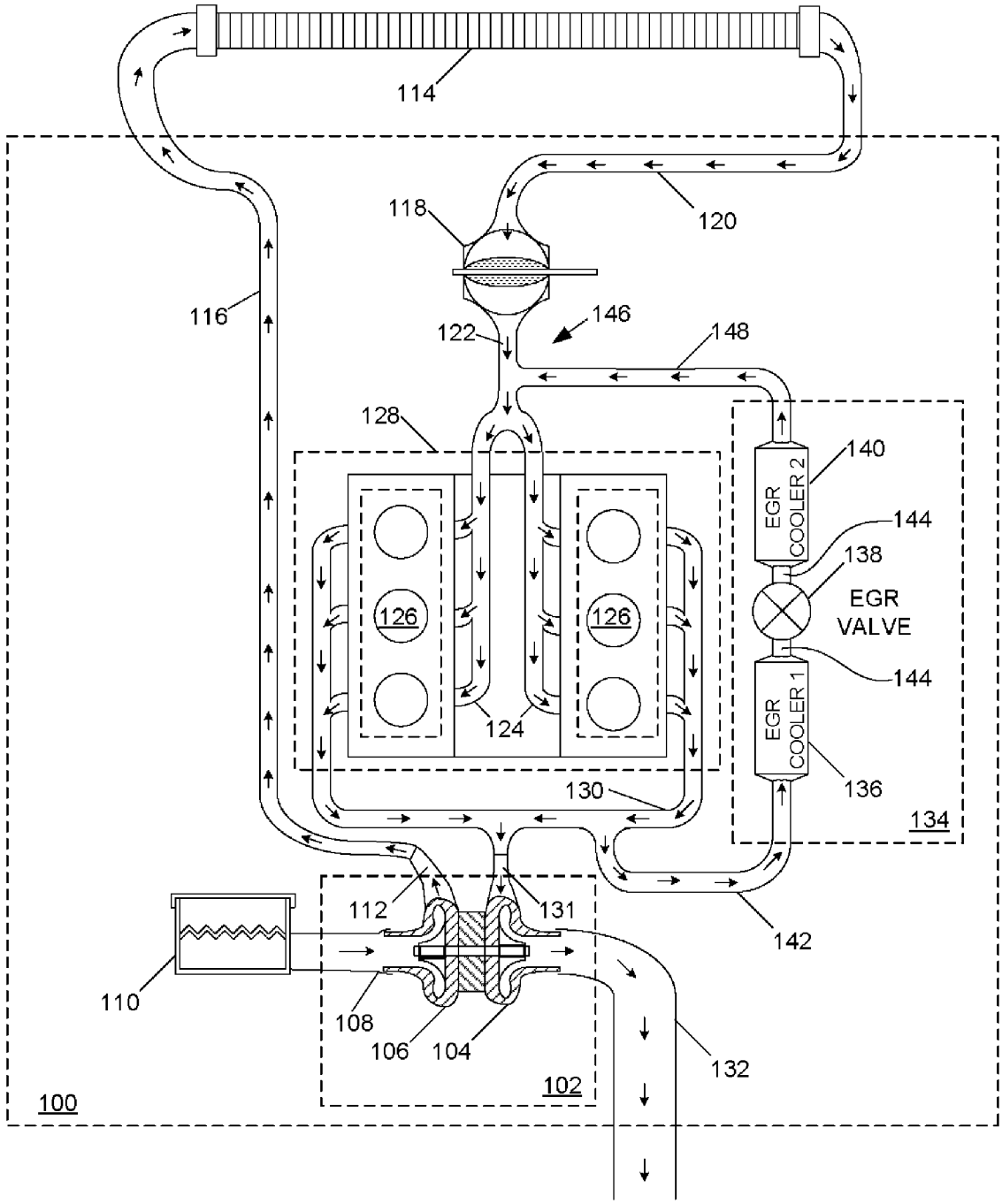
FIG. 1 is a block diagram of an internal combustion engine having an EGR system associated therewith in accordance with the invention.

A block diagram of an engine 100 having an EGR system, as installed in a vehicle, is shown in FIG. 1. The engine 100 includes a turbocharger 102 having a turbine 104 and a compressor 106. The compressor 106 has an air inlet 108 connected to an air cleaner or filter 110, and a charge air outlet 112 connected to a charge air cooler (CAC) 114 through CAC-hot passage 116. The CAC 114 has an outlet connected to an intake throttle valve (ITH) 118 through a CAC-cold passage 120. The ITH 118 is connected to an intake air pipe 122 that fluidly communicates with an intake system of the engine 100, generally shown as 124. Branches of the intake system 124 are fluidly connected to each of a plurality of cylinders 126 that are included in a crankcase 128 of the engine 100.

Each of the plurality of cylinders 126 of the engine is connected to an exhaust system, generally shown as 130. The exhaust system 130 of the engine 100 is connected to an inlet 131 of the turbine 104. An exhaust pipe 132 is connected to an outlet of the turbine 104. Other components, such as a muffler, catalyst, particulate filter, and so forth, may be connected to the exhaust pipe 132 but are not shown for the sake of simplicity.

The engine 100 has an EGR system, generally shown as 134, associated therewith. The EGR system 134 includes a first EGR cooler 136, an EGR valve 138, and a second EGR cooler 140, all connected in a series configuration with each other for passage of exhaust gas therethrough. The first EGR cooler 136 fluidly communicates with the exhaust system 130 through an EGR gas supply passage 142. The EGR valve 138 is disposed in line with a connecting gas passage 144 that connects a gas outlet of the first EGR cooler 136 with a gas inlet of the second EGR cooler 140. The gas outlet of the second EGR cooler is in fluid communication with a junction 146 that is part of the intake air pipe 122 through a cooled-EGR passage 148.

During operation of the engine 100, air is filtered in the filter 110 and enters the compressor 106 through the inlet 108 where it is compressed. Compressed, or charged, air exits the compressor 106 through the outlet 112 and is cooled in the CAC 114 before passing through the ITH 118. Air from the ITH 118 is mixed with exhaust gas from the cooled-EGR passage 148 at the junction 146 to yield a mixture. The mixture passes to the intake system 124 through the intake pipe 122 and enters the cylinders 126. While in the cylinders 126, the mixture is additionally mixed with fuel and combusts yielding useful work to the engine 100, heat, and exhaust gas. The exhaust gas from each cylinder 126 following combustion is collected in the exhaust system 130 and routed to the turbine 104. Exhaust gas passing through the turbine 104 yields work that is consumed by the compressor 106.

A portion of the exhaust gas in the exhaust system 103 bypasses the turbine 104 and enters the EGR gas supply passage 142. Exhaust gas entering the passage 142 is exhaust gas that will be recirculated into the intake system 124. The recirculated exhaust gas is cooled for a first time in the first EGR cooler 136, its amount is metered by the EGR valve 138, and then the gas is cooled for a second time in the second EGR cooler 140 before being routed to the junction 146 for mixing with the charge air exiting the ITH 118.

Figure 2:
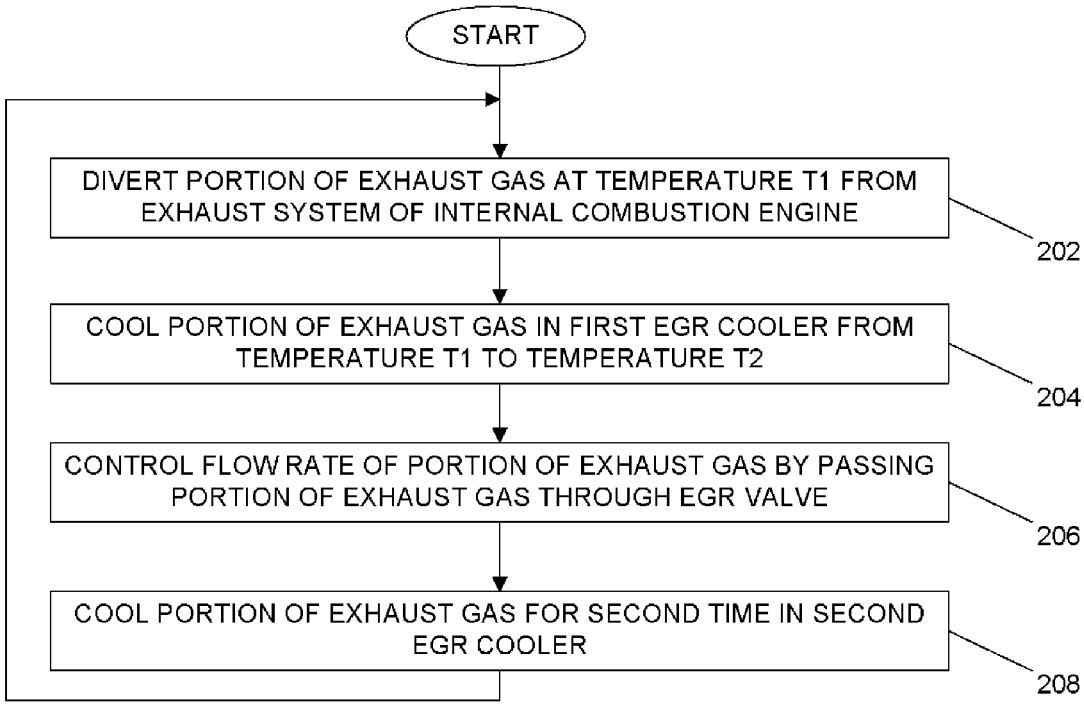
FIG. 2 is a flowchart for a method of cooling recirculated exhaust gas for an engine having an EGR system in accordance with the invention.

A flowchart for a method of cooling recirculated exhaust gas for an engine having an EGR system is shown in FIG. 2. A portion of an exhaust flow is diverted from an exhaust system of the engine at step 202. The portion of exhaust flow is at a first temperature, T1, when diverted from the exhaust system. The portion of exhaust flow is cooled to a second temperature, T2, in a first EGR cooler at step 204. The first temperature T1 of exhaust gas being diverted from the exhaust system of the engine may be about, for example, 425 deg.C. or substantially higher depending on an operating condition. The first EGR cooler may advantageously lower this temperature to the second temperature T2 that is below the 425 deg.C. but above a minimum allowable condensation temperature, Tcdns, of about 200 deg. C. under which constituents in the exhaust gas will begin to condense. The second temperature T2, therefore, may advantageously be between 200 deg.C. and 425 deg. C., but still below a maximum tolerable temperature, Tmax, of the EGR valve.

The portion of exhaust gas passes through an EGR valve such that its flow rate is controlled at step 206. The EGR valve remains advantageously mostly free of condensates because the exhaust gas passing therethrough is at or about the second temperature T2 which is above the condensation temperature Tcdns for exhaust gas constituents. Due to engine emissions requirements, the second temperature T2 of the portion of exhaust gas may not be low enough to yield combustion in the engine that generates a desired proportion of emissions under all engine operating conditions. For this reason, the portion of exhaust gas is cooled a second time by passing through a second EGR cooler at step 208. The second EGR cooler advantageously cools the portion of exhaust gas even further, after it has passed through the EGR valve, from the second temperature T2 to a third temperature, T3, which is a desired temperature for emissions. The third temperature T3 may be below the minimum limit Tcdns of about 200 deg.C. and may be about 175 deg.C. or below. Exhaust gas at this lower third temperature T3 may cause condensation of constituents from the exhaust gas, but this condensation occurs either within the second EGR cooler, or at some region of the intake system of the engine where it is harmless to moving components of the EGR valve. Moreover, existing EGR cooler technology advantageously enables periodic cleaning of EGR coolers of deposits.

Figure 3:
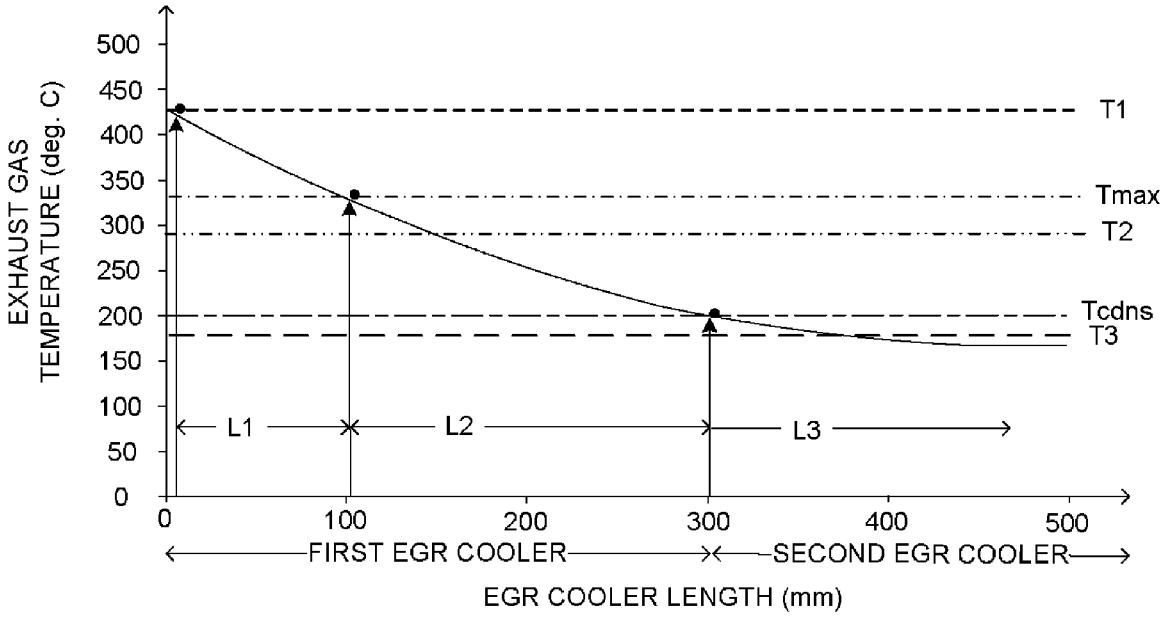
FIG. 3 is a graph illustrating various parameters in accordance with the invention.

A graphical representation of various exhaust gas temperature parameters discussed herein is presented in FIG. 3. In the graph, the vertical axis represents exhaust gas temperatures, ranging between 0 and 500 deg.C., of the portion of exhaust gas being recirculated in an engine during operation. The horizontal axis represents an active tube length for EGR coolers, ranging from 0 to 500 or more mm. Also in the graph, T1 represents a temperature of about 425 deg. C. of exhaust gas diverted from the exhaust system of the engine. Tmax represents a maximum tolerable temperature of an EGR valve, for example, a temperature of about 330 deg. C., above which an EGR valve may experience thermal failures. T2 represents an operating temperature of exhaust gas passing through the EGR valve after having been cooled for a first time in a first EGR cooler. Tcdns represents the temperature below which constituents in the exhaust gas condense. T3 represents a desired temperature of exhaust gas for engine emissions.

Along the horizontal axis, L1 represents a cooler length of about 100 mm that is required to cool the recirculated exhaust gas from T1 to at least Tmax, or alternatively, to cool exhaust gas from the exhaust system temperature down to at least the maximum tolerable temperature of the EGR valve. L2 represents an additional length of about 200 mm of EGR cooler active length that lowers the temperature of exhaust gas from Tmax to Tcdns, or, that lowers the temperature of exhaust gas up to or above the condensation temperature of constituents. L3 represents the additional EGR cooler active length that is required to lower the temperature of exhaust gas to T3, or, to a desired temperature of recirculated exhaust gas for proper emissions of the engine.

As shown in the graph and in accordance with the description above, the first EGR cooler can have an active length, X, where $L1 \leqq X \leqq (L1+L2)$. The second EGR cooler can have an active length, Y, that is required to yield the desired T3 outlet temperature, where $Y=(L1+L2-X+L3)$. In this fashion, the active length X of the first EGR cooler advantageously ensures that the EGR valve will not undergo any thermal ill effects, and that also, the EGR valve will not experience condensation thereon of exhaust gas constituents. As can be appreciated by one in the art, the active lengths for EGR coolers described herein represent a quantifiable measure of EGR cooler effectiveness that depends on the specific geometry and type of a specific EGR cooler type and design. Different EGR coolers, depending on the technology employed and depending on geometrical characteristics, may require different active lengths or may be constructed in an entirely different fashion. Any method of EGR cooler effectiveness determination is contemplated to fall within the scope of the invention. Moreover, any method that will size a first EGR cooler to yield an exhaust gas temperature for use with an EGR valve that falls between the limits described herein is contemplated as equivalent to the embodiments illustrated above.

This method of placing an EGR valve between two EGR coolers finds special advantage in applications wherein a single engine platform is used by a manufacturer of engines as a basis for more than one engine applications or products. For example, a single engine can be used as a base platform for many engine products and applications having different displacements, power ratings, and so forth. In this situation, a first EGR cooler can be designed to satisfy the requirements of all engine applications, and one or more second EGR cooler(s) may be added to each engine application such that engine application specific requirements are met. By commonizing the first EGR cooler across all applications, cost and complexity of the engine applications considered as a family may advantageously be reduced.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An internal combustion engine comprising:

a crankcase that includes a plurality of cylinders;

an exhaust system in fluid communication with the plurality of cylinders, wherein the exhaust system includes a turbine in operable association with a compressor;

an intake system in fluid communication with the plurality of cylinders and the compressor;

a first exhaust gas recirculation (EGR) cooler in fluid communication with the exhaust system through an inlet passage that is connected to the exhaust system between the plurality of cylinders and the turbine;

a second EGR cooler in fluid communication with the intake system through an outlet passage that is connected to the intake system between the plurality of cylinders and the compressor, wherein the second EGR cooler is in fluid communication with the first EGR cooler, and wherein the second EGR cooler is connected to the first EGR cooler in a series configuration;

a transfer passage disposed between the first EGR cooler and the second EGR cooler; an EGR valve, disposed within the transfer passage, having a predetermined maximum temperature limit, that is arranged and constructed to control a flow of fluid through the transfer passage while the internal combustion engine operates; and wherein the first EGR cooler cools the flow of exhaust passing through it from a first temperature that exceeds the condensation temperature of the exhaust and the maximum temperature limit for the EGR valve to a second temperature that still exceeds the condensation temperature of the exhaust but not the maximum temperature limit for the EGR valve as the exhaust passes through the transfer passage, and the second EGR cooler further cools the exhaust passing through it to a third temperature within a range that includes the condensation temperature of the exhaust.

2. A method of cooling recirculated exhaust gas in an internal combustion engine having an exhaust gas recirculation (EGR) system associated with an exhaust system, the method comprising the steps of:

diverting a portion of exhaust gas having a first temperature from the exhaust system to a first EGR cooler where the diverted exhaust gas is cooled from the first temperature to a second and lower temperature;

controlling rate of flow of the diverted exhaust gas at the second temperature with an EGR valve; and cooling the diverted exhaust gas for a second time in a second EGR cooler from the second temperature to a third and still lower temperature;

wherein the first temperature exceeds the condensation temperature of the diverted exhaust gas and a maximum temperature limit for the EGR valve, the second temperature exceeds the condensation temperature of the diverted exhaust gas but not the maximum temperature limit for the EGR valve, and the third temperature lies within a temperature range that includes the condensation temperature of the diverted exhaust.

3. The method of claim 2, wherein the first temperature is at least 425 degrees C.

4. The method of claim 3, wherein the third temperature is no greater than 200 degrees C.

5. An engine as set forth in claim 1 wherein the first temperature is defined as the temperature of the exhaust gas exiting the combustion chamber.

6. An engine as set forth in claim 5 wherein the third temperature is no greater than 200° C.

* * * * *